US007293777B2

(12) United States Patent
Lewis

(10) Patent No.: US 7,293,777 B2
(45) **Date of Patent: *Nov. 13, 2007**

(54) TEST-CUTTING TARGET FOR EDGED-WEAPONS PRACTICE

(76) Inventor: George C. Lewis, 3838 Animas Way, Superior, CO (US) 80027

( * ) Notice: Subject to any disclaimer, the term of this patent is extended or adjusted under 35 U.S.C. 154(b) by 243 days.

This patent is subject to a terminal disclaimer.

(21) Appl. No.: 10/769,020

(22) Filed: Jan. 29, 2004

(65) Prior Publication Data

US 2005/0167925 A1 Aug. 4, 2005

(51) Int. Cl.
*F41J 3/00* (2006.01)

(52) U.S. Cl. ..... 273/403; 434/247; 273/348

(58) Field of Classification Search ..... 273/403, 273/408, 348, 464; 446/486, 473; 5/636; 434/247

See application file for complete search history.

(56) References Cited

U.S. PATENT DOCUMENTS 3,842,453 A * 10/1974 Redfield ..... 5/643
4,066,261 A * 1/1978 Stewart ..... 273/403
4,239,236 A * 12/1980 Parham et al. ..... 273/403
4,328,966 A * 5/1982 Miyamoto ..... 446/473
4,916,765 A * 4/1990 Castronovo, Jr. ..... 5/640
5,219,163 A * 6/1993 Watson ..... 463/47.2
5,324,227 A * 6/1994 Yuh-Ching ..... 446/473
5,971,398 A * 10/1999 Broussard et al. ..... 273/408
6,010,435 A * 1/2000 Tanabe ..... 482/83
6,360,388 B2 * 3/2002 Langer ..... 5/632
6,449,788 B1 * 9/2002 Nichols ..... 5/636
6,823,546 B1 * 11/2004 Hsu ..... 5/636

OTHER PUBLICATIONS

E-bogu.com, Inc., Kendo & Martial Arts Equipment Catalog, p. 41.
Bladeart.com, Guidelines for Use, http://www.bladeart.com/swords/tinkerblades_guidelines_for_use.htm, Jan. 2004.
Parting Strike Swords, LLC, Test Cutting Results, www.partingstrikeswords.com, 2003.
Tsuki Kage dojo, Tameshigiri Materials & Sequences, http://www.tsuki-kage.com/shizan.html, 2003.

* cited by examiner

*Primary Examiner*—Mark S. Graham

(57) ABSTRACT

Embodiments of the present invention are improved targets suitable for cutting with an edged weapon. In an embodiment the target may be a traditional straw mat target held together by a hydraulic binder composition. In yet other embodiments, the target may be made of multiple layers of synthetic materials to give different properties. One embodiment is a target with an inner portion and an outer portion. The outer portion may be selected from a material that gives the appropriate initial cutting properties while the inner portion provides a cutting resistance. In addition, shaped targets having multiple differing cutting surfaces are disclosed, as is a method for creating a target to simulate a predefined sequence of cuts.

11 Claims, 15 Drawing Sheets

TEST-CUTTING TARGET FOR EDGED-WEAPONS PRACTICE

COPYRIGHT NOTICE

As per 37 CFR §1.71(e), a portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

This application relates generally to martial arts equipment and more particularly to an improved target for cutting with edged weapons.

BACKGROUND OF THE INVENTION

Martial arts, such as karate, tae kwon do, judo and aikido, have become popular in the United States and worldwide. Even less mainstream martial arts, such as ju jitsu, kendo and krav maga, now have significant followings.

As these oriental arts have evolved, nearly all have begun to introduce weapons practice as part of the standard curriculum. One no longer needs to take a sword-oriented martial art such as kendo or iaido to receive instruction in the use of a Japanese sword as this instruction is now offered in other oriental martial arts including karate, ju jitsu, aikido and even judo. In addition to the increase in weapons training in oriental martial arts, there has been a resurgence in interest in medieval and western martial styles through the Society for Creative Anachronism, renaissance festivals, fencing and the like, which has also added to the popularity of sword and edged weapons training.

One aspect of sword and edge weapons training that is gaining popularity is actual cutting of targets with real weapons. For example, one element of traditional Japanese sword training is called tameshigiri, or test cutting practice. In traditional tameshigiri, a swordsman practices his swing and posture by cutting a cylindrical target with a sword or other weapon. In traditional tameshigiri, the targets are typically made by rolling tatami omote (a woven rice mat) into a cylinder. Other target are young (i.e. wet) bamboo of various diameters, or cylindrical bails of straw.

FIG. 1 shows side views of two designs for test cutting stands for use with typical cylindrical test-cutting targets. A vertical stand 100 may be provided to which a target 102 (shown as a dotted outline) may be vertically attached for practicing diagonal and horizontal cuts as targets 102 on this stand exhibit a vertical cutting surface. Typical vertical stands 100 include a vertical member 110 (often a 4×4 wooden post) stabilized by base 112 of some type (in this case, multiple 4×4 fixed to the four sides of the vertical member 110) provided with a retaining pin or peg 104 for penetrating the target 102. Another traditional stand 106, referred to as a dotangiri stand 106, is shown in FIG. 1 for holding one or more targets 102 (three targets 102 are illustrated) to provide a horizontal surface for practicing vertical cuts. The dotangiri stand 106 shown has two vertical members 130 attached to a base adapted to retain cylindrical targets 102 horizontally between them. The retained targets 102 often are retained in opposing slots (not shown) formed in the vertical members 130 and rest on a crossbar 132 that attaches the vertical members 130.

Tameshigiri probably represents the most organized form of test cutting training. Its techniques and materials are borrowed by many other arts and styles for similar training. However, the materials and design of test-cutting targets as used in tameshigiri have several drawbacks. First, they are relatively expensive. At $3 to $5 per target, which is destroyed when used, the cost of extensive training is very high.

Second, they are messy and require extensive clean up of the training area after practice. Typically a woven mat (tatami) target will partially separate after cutting, releasing a multitude of small individual lengths of straw or whatever the mat is woven out of in the practice area. These are difficult and time consuming to clean up.

Third, they are dangerous to the practitioner in that splinters and sharp edges may result during cutting. This is especially true as most martial arts require exponents to practice barefoot. Small slivers and pieces of target can injure the feet during practice.

Fourth, they can damage the weapons through scratches and abrasions to the cutting surface. This is especially true if 'used' tatami mats are made into targets. The used mats typically contain grains of sand and other particles that can scratch the highly polished weapons typically used in such practice.

Fifth, they require significant amount of preparation time—often requiring that they be assembled and then soaked in water for a day prior to using.

Sixth, the targets do not have the same cutting properties in different directions. For example, a woven tatami mat rolled into a long, cylindrical target is easily cut along its long axis, but hard to cut perpendicular to its long axis. All natural wood targets also exhibit this trait in one way or another. Cutting the target with the grain is easier than cutting against the grain. This is also a drawback when attempting to recreate kata when doing test cutting. For example, the first kata of most forms of Iaido is a seated form starting with a horizontal cut at the height of the opponent's neck and followed by a an vertical cut to the opponent's body. Because the cuts are in rapid succession to the same location, only a single target can be used. However, a typical target, because the properties are not uniform, is not suitable for such practicing this kata.

Seventh, the typical targets are limited to cylindrical shape. This is a drawback when attempting to do large cuts, requiring that multiple cylindrical targets be held on a stand side by side. For example, to practice a dotangiri (overhead vertical cut straight down), multiple cylindrical targets are vertically stacked. In addition, in martial arts that use swords, there are often specific sequences of cuts that are routinely practiced, and routine targets that routinely attached. For example, in Kendo and Iaido, there are four basic targets on the human body—the body called "do", the head called "men", the wrists called "kote", and the throat called "tsuki". Most practice sequences (referred to as "kata") in Kendo and Iaido are combination of attacks to these targets. These targets are shown in FIG. 2*a*. For example, common sequences in Kendo include kote-men and kote-do. In kote-men the practitioner attacks the opponent's wrist and then the opponent's head in a fast sequence of strikes. In kote-do, the practitioner attacks the wrist and then the body of the opponent. While this is possible using the flexible shinai practice sword in Kendo, typical tamishigiri targets because they are single cylinders do not allow this combination of cuts to be performed on the same target.

In addition, Kendo and Iaido practice includes striking these points on opponents in different standard kamae, or stances. FIG. 2*a* illustrates a kendoka in the middle stance referred to as chudan no kamae. FIG. 2*b* illustrates the three primary kamae in kendo, although there are many others. A brief description of the stances 204, 206, 208, are as follows:

Chudan No Kamae 204 In chudan no kamae, one's shoulders squarely face the opponent. The left hand is held three or four inches in front of the navel. The right hand is held so that the tip of the sword is throat height. Both elbows are slightly bent, and both hands are directly on the center line.

Jodan No Kamae 206 In jodan (high) stance, one holds the sword up above the head. The elbows are bent, and the left hand is slightly above, and in front of the forehead. The blade tilts backward at a 30 to 45 degree angle, and the cutting edge faces forward.

Gedan No Kamae 208 The gedan (low) stance is similar to the chudan no kamae. From chudan no kamae, lower the blade tip to knee level by lowering the right hand without moving the left hand.

Eighth, the properties of the targets, because they are made from natural products such as wood and straw, change from one target to the next. Thus making it difficult to gauge the power of one's cutting from cut to cut. This also poses a problem in competitions where one competitor can have targets with properties that differ from other competitor's targets.

Accordingly there is a need for an improved tameshigiri target. One that requires less time to prepare and that reduces the clean up time after use. Furthermore, a target that is reuseable, inexpensive and does not represent a danger to the user or the weapons would be preferred. Embodiments of the present invention provides a solution to one or more of these and other problems, and offers other advantages over the prior art.

SUMMARY OF THE INVENTION

Against this backdrop the present invention has been developed. Embodiments of the present invention are improved targets suitable for cutting with an edged weapon. In an embodiment the target may be a traditional straw mat target held together by a hydraulic binder composition.

In another embodiment, the target may be made out of one or more synthetic materials having uniform cutting properties such as medium density polyurethanes, various polyethylene foams, plastics, wood pulps and wood pulp products, or paper-based materials.

In yet other embodiments, the target may be made of multiple layers of materials to give different properties. One embodiment is a target with an inner portion and an outer portion. The outer portion may be selected from a material that gives the appropriate initial cutting properties. The inner material may be selected from materials that have the appropriate density and cutting resistance. The outer portion may provide structural support that prevents fracturing of the inner portion during a cut. The outer portion may also provide an easily cuttable surface allows easy penetration by a weapon, thereby preventing the weapon from bouncing freely off the inner denser material. The targets may be formed in cylinders, blocks or any combination of shapes including approximating the shape of a person or animal.

Other embodiments of the present invention are targets specially shaped to facilitate specific cutting techniques and specific series of cuts. One embodiment is a chudan kote-men target shaped to provide a roughly vertical target approximating the location of a person's wrist while holding a sword in chudan no kamae and also shaped to provide a spherical or vertical target approximating a person's head. Another embodiment is a jodan kote-do target having a vertical target approximating the location of person's left wrist while holding a sword in jodan no kamae and having a horizontal target approximating the location of a person's body while in jodan no kamae.

Embodiments of the present invention also include a method of creating test-cutting targets for cutting by an edged weapon. The method includes identifying a sequence of cuts, such as the cuts in a predefined kata, to be practiced that require a plurality of differing cutting surfaces. Then identifying each of the differing cutting surfaces necessary to practice those cuts and a relative position of each of the surfaces necessary to perform the sequence. Then forming a test-cutting target of one or more uniform cutting materials having each of the plurality of differing cutting surfaces. The target must be formed so that each of the plurality of differing cutting surfaces are located at the relative position necessary to perform the sequence. The sequence of cuts may also include thrusts and therefore the target may also require one or more tsuki surfaces for receiving thrusts.

These and various other features as well as advantages which characterize the present invention will be apparent from a reading of the following detailed description and a review of the associated drawings.

DETAILED DESCRIPTION

Embodiments of the present invention are improved targets for edged-weapons. Embodiments include improved targets made of traditional materials, improved shipping containers and methods of shipping traditional targets to facilitate their use, targets made of synthetic materials, and targets shaped to provide multiple different target surfaces for use in practicing multiple cut sequences.

Improved Targets Comprising Traditional Materials

Embodiments of the present invention are test-cutting targets made from traditional material, such as tatami omote or similar mats containing a plurality of individual strands of material such as straw, that are bound together by a chemical binding agent to prevent the individual strands from separating from the target after being cut. In embodiments, mats are formed into targets and soaked in a water bath as normal. The binding agent is applied to the bath, or to the mat before or after soaking, as appropriate depending on the binding agent. The target is removed from the bath and used in cutting practice. The binding agent in the target prevents individual strands from being separated from the target during and after the cutting practice, possibly even after the targets begin to dry out.

The actual method of applying the binding agent to the target varies depending on the binding agent used. In one embodiment, a binding agent is added to the water while the targets are soaking. The addition is performed a predetermined amount of time prior to the anticipated removal of the target from the bath. For example, for a polymeric binding composition, the reagents may be added to the bath just prior to use. The binder polymerizing after the target is removed from the bath and the water begins to evaporate.

Suitable binding agents are well known in the art. An example of a suitable binding agent is the subject of U.S. Pat. No. 5,459,181 to West, et al (hereinafter "West"). The background of West provides several additional binding agents that are also suitable for holding targets together.

In another embodiment, an inactive binding agent is applied to the mats during manufacture. The binding agent may be sprayed on or otherwise applied to the exterior surfaces of the mat. Upon application of the water, the binding agent on the target activates and binds individual strands of the target to neighboring strands. This embodiment has advantages as the user does not need to add any binding agent to the bath and, if the appropriate binding agent is used, the binding agent will not foul the water bath.

Shipping in a Container Capable of Holding Water

Figure 3:
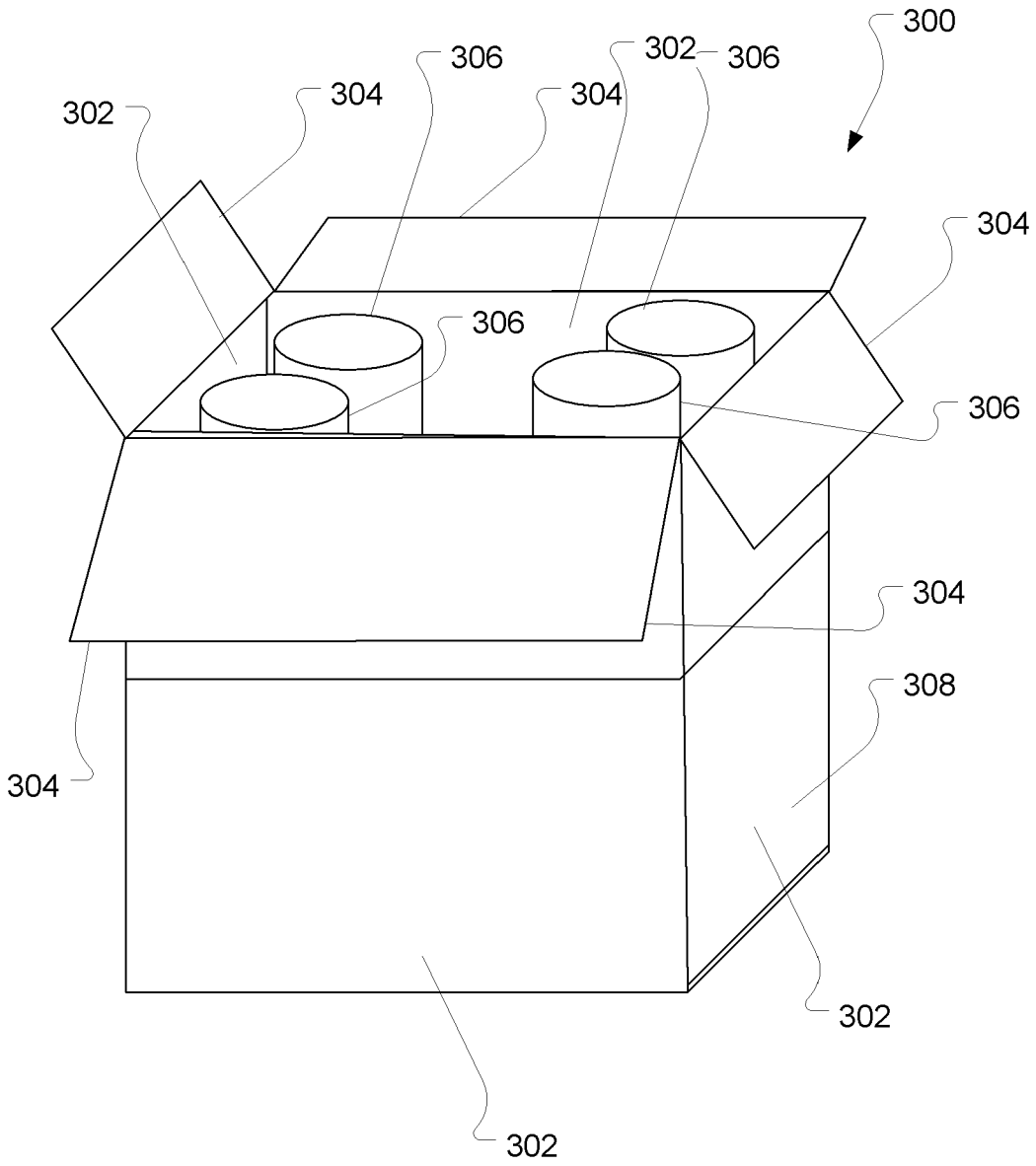
FIG. 3 presents a view of a shipping container in accordance with the present invention.

Embodiments of the present invention are a kit that includes some number of pre-roled or pre-shaped targets and a shipping container. The shipping container is designed to allow the end user to prepare the target for use without the need for an additional container for soaking the targets. FIG. 3 presents a view of a shipping container in accordance with the present invention. The is a box-type container 300 that has four side walls 302, a bottom (not shown) and a top made of four closable flaps 304. The top is made of multiple flaps 304 that fold down to form the top and can be opened to allow removal of the targets 306 within. In FIG. 3, the targets 306 are illustrated as simple cylindrical targets 306. Four targets 306 are shown. A lower portion 308 of the container is water proof. When the lower portion 308 is filled with water, the target material such as straw draws the water up via capillary action into the targets. The depth of the lower portion 308 relative to the depth of the container is based on the estimated capillary suction of the target material. For tatami omote, the capillary suction is expected to cause water to be sucked 3 to 4 inches higher in the tatami omote strands than the existing water level. Thus the water proof lower portion 308 in this case would be the lower portion of the container and come to within 3 or 4 inches of the top of the tatami omote targets. The lower portion 308 may be made water proof by applying a water proof coating to the container, lining the lower portion 308 of the container 300 with a water proof material, or making the lower portion 308 of a different material that the remaining container 300.

Improved Targets Comprising Multiple Materials

As discussed in the background, one drawback of traditional targets is the non-uniformity of materials. Embodiments of the present invention are test-cutting targets made of materials that have uniform cutting properties, such as shear strength, impact resistance, and tear strength. This allows the practitioner to be certain that each target will have the same properties and that any variation in his cuts is due to the practitioner's form rather than variations between targets.

One embodiment is a test-cutting target made of polyurethane. Another embodiment is a test-cutting target made of a hardened foam such as polyurethane or polyethylene foam. Wood pulp is also a suitable material.

Figure 4:
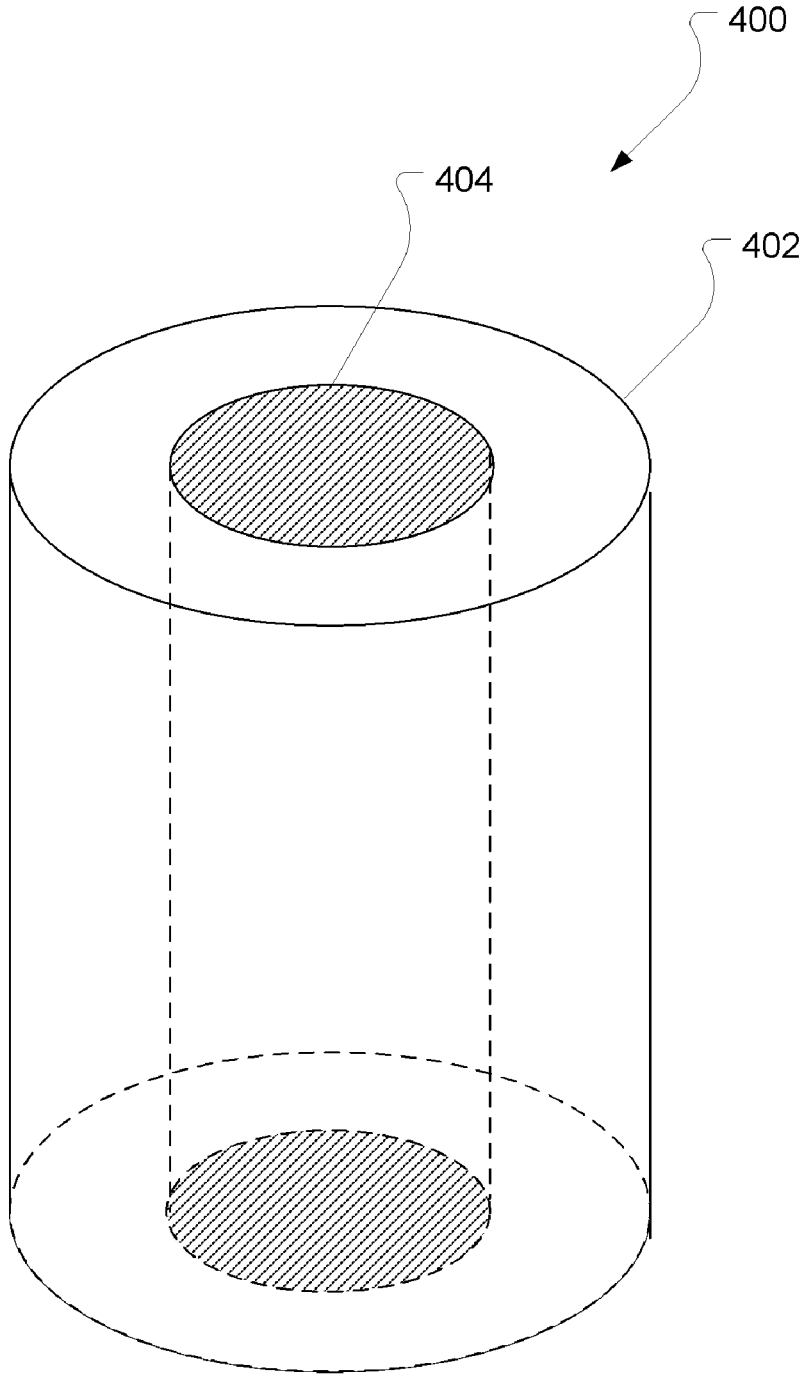
FIG. 4 presents a cylindrical test-cutting target made of two different cuttable materials in accordance with an embodiment of the present invention.

The density of the target may be varied without changing the size and shape of the targets by creating targets having an outer portion and an inner portion of denser material. For example, the 4 inch diameter standard cylinder target 400 could include a 2 inch inner cylindrical core 404 sheathed by a one inch outer sheath. The outer sheath 402 being an annulus (i.e. tube) with an inner diameter of 2 inches and an outer diameter of 4 inches as shown in FIG. 4.

Figure 1:
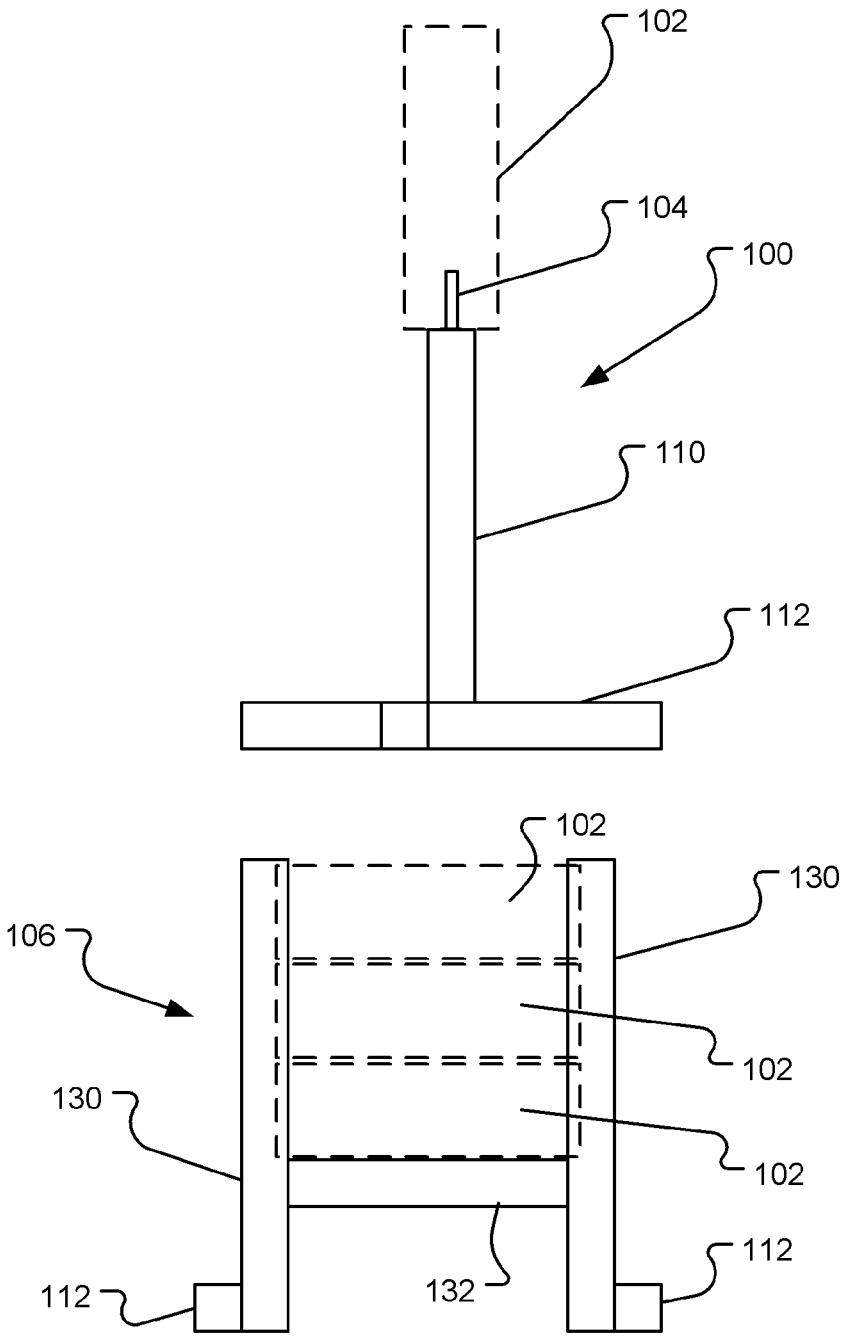
PRIOR ART FIG. 1
FIG. 1 shows the side view of two typical tameshigiri stands for holding test-cutting targets.
Figure 2A:
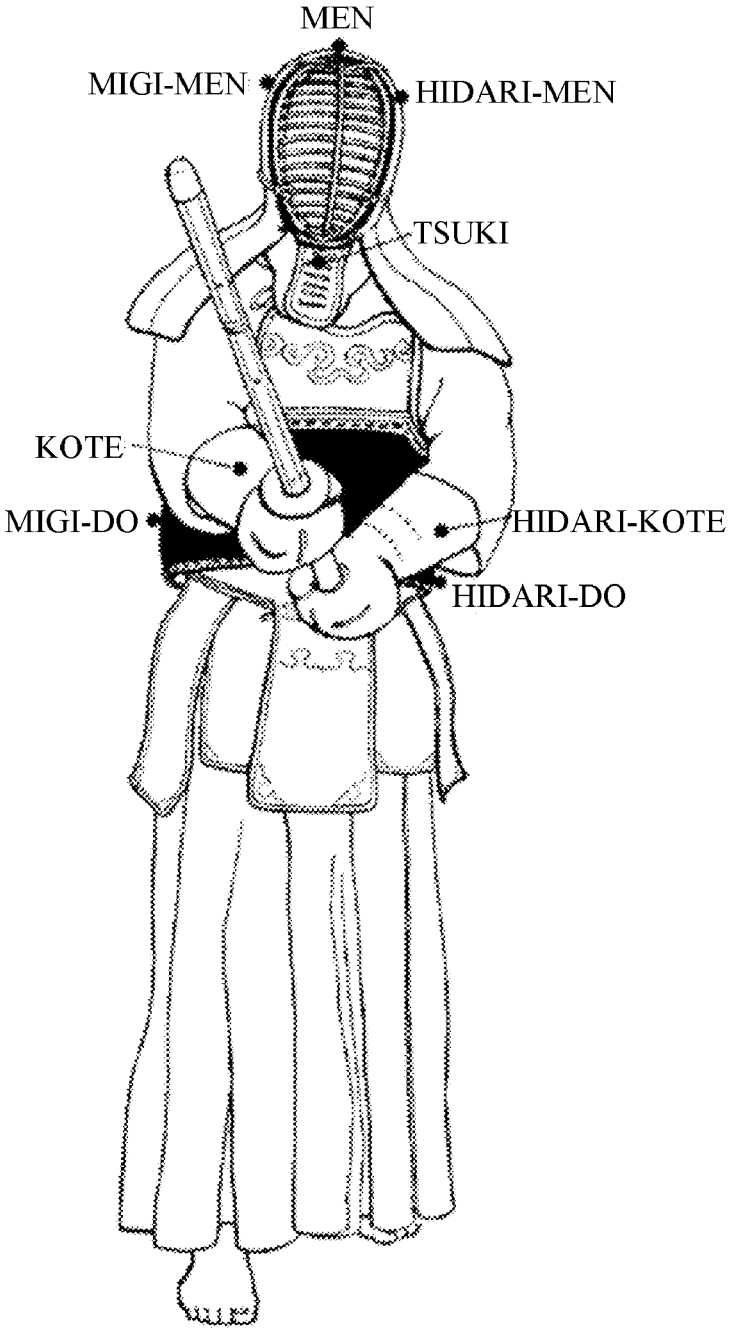
PRIOR ART FIG. 2a
FIG. 2*a* is an illustration of a kendoka in the chudan no kamae (middle stance) showing the valid striking points common in Kendo and Iaido.
Figure 2B:
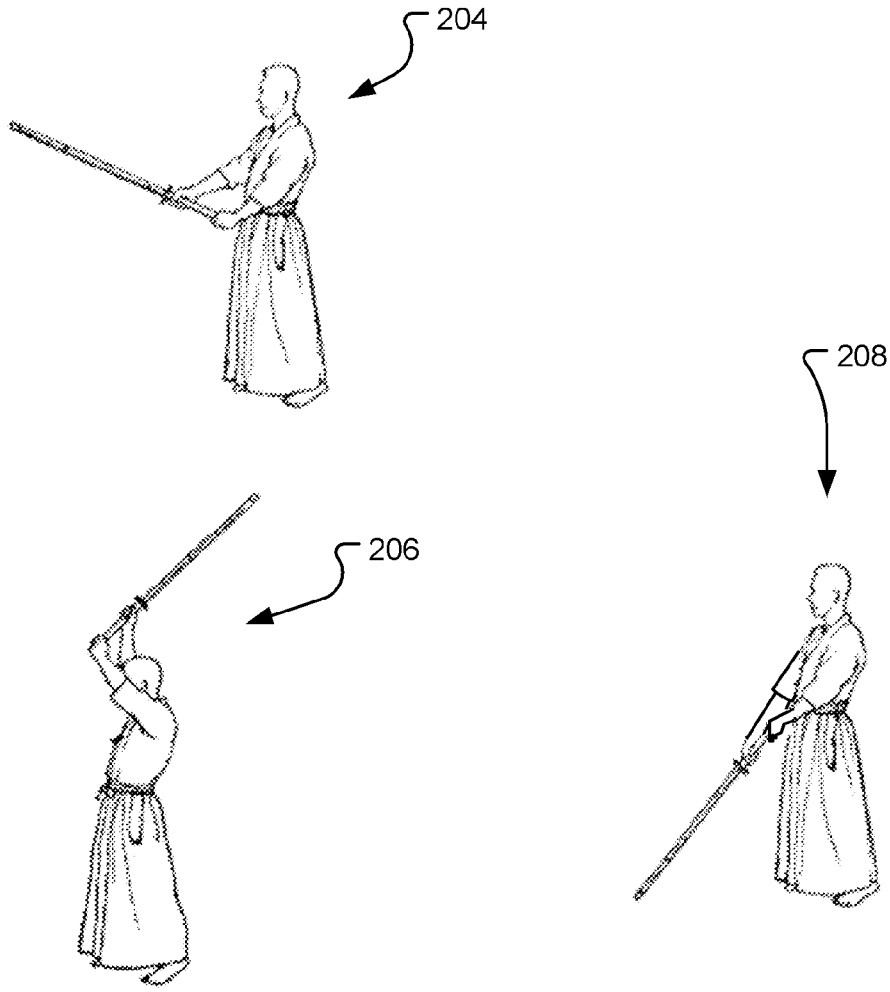
PRIOR ART FIG. 2b
FIG. 2*b* is an illustration of the three primary kamae (stances) used in Kendo and Iaido.

The core 404 may be provided with a hole (not shown) at one or both ends for receiving a peg from a traditional stand as shown in FIG. 1. Such a hole may be a cylindrical hole or may be a hexagonal or octagonal hole. In order to prevent a practitioner from cutting into a peg, a line or other visual indicator may be provided on the target for each peg hole indicating the depth of such a peg hole into the target or, alternatively, a safe cutting location based on the depth of the peg hole.

By varying the density and/or cutting properties of the material in the core 404, the cutting properties of the target could be varied without changing the size or shape of the target. Furthermore, by maintaining a consistent outer sheath 402 material, the initial cutting properties remain unchanged. This is a benefit to the practitioner as it prevents the weapon from bouncing off of the denser material in an uncontrolled manner. If a cut is made at too shallow an angle, the weapon will be deflected into the annular region of the sheath 402 and not bounce freely away from the target.

Differing target densities and/or cutting properties may be identified by cores 404 of different color. If the cores 404 are exposed as shown in FIG. 4, this would allow a practitioner an easy means for identifying the cutting properties of and selecting the target. For example, different properties and colors of polyethylene foam may used in different cutting property targets, while the sheath material remains constant. Of course, other indicators could also be used, such as different color sheaths, textual indicators, or similar markings.

Such multiple material targets may also incorporate traditional materials. For example, the core 404 of the target may be tatami omote or even unwoven straw. The core 404 would then be contained by an outer sheath 402 of some second material such as cardboard or polyethylene foam, both of which would allow the target to be soaked in water before use. Another example is a cardboard outer sheath 402 filled with a core 404 of polyethylene foam. The outer tube serves to hold the foam together and prevent the foam from being torn during cutting.

Such multiple density targets could be adapted to multiple configurations and shapes, such as discussed in the next section, and are not limited to the simple cylindrical target shown in FIG. 4. For example, laminated sheets of material may be used to provide targets having rectangular cross sections. Such sheets may include two outer layers of sheath material sandwiching an inner core layer of material.

When selecting material for the core and outer sheath portions, densities are important. Such material should be heavy enough to withstand the impact of a weapon, but not so heavy as to cause damage to the weapon. Traditional materials, such as tatami omote, when cut range in specific gravity from between 0.5 to 1.5, generally being about 0.8 to 0.9. Densities of polyethylene foam range from 6 pounds per cubic foot (approximately 0.08 specific gravity) to greater than 50 pounds per cubic foot (0.9 specific gravity). Even greater densities of other materials are possible up to 1.5 specific gravity, however, the consideration of cost of shipping may make the heavier material less economical.

Thus, an easy cylindrical target in accordance an embodiment of the present invention may have, for example, a 6 pound polyethylene sheath and a 10 pound polyethylene core. A hard target may be provided with a 15 pound polyethylene core (preferably of a different color).

Shaped Targets with Different Cutting Surfaces

Figure 5A:
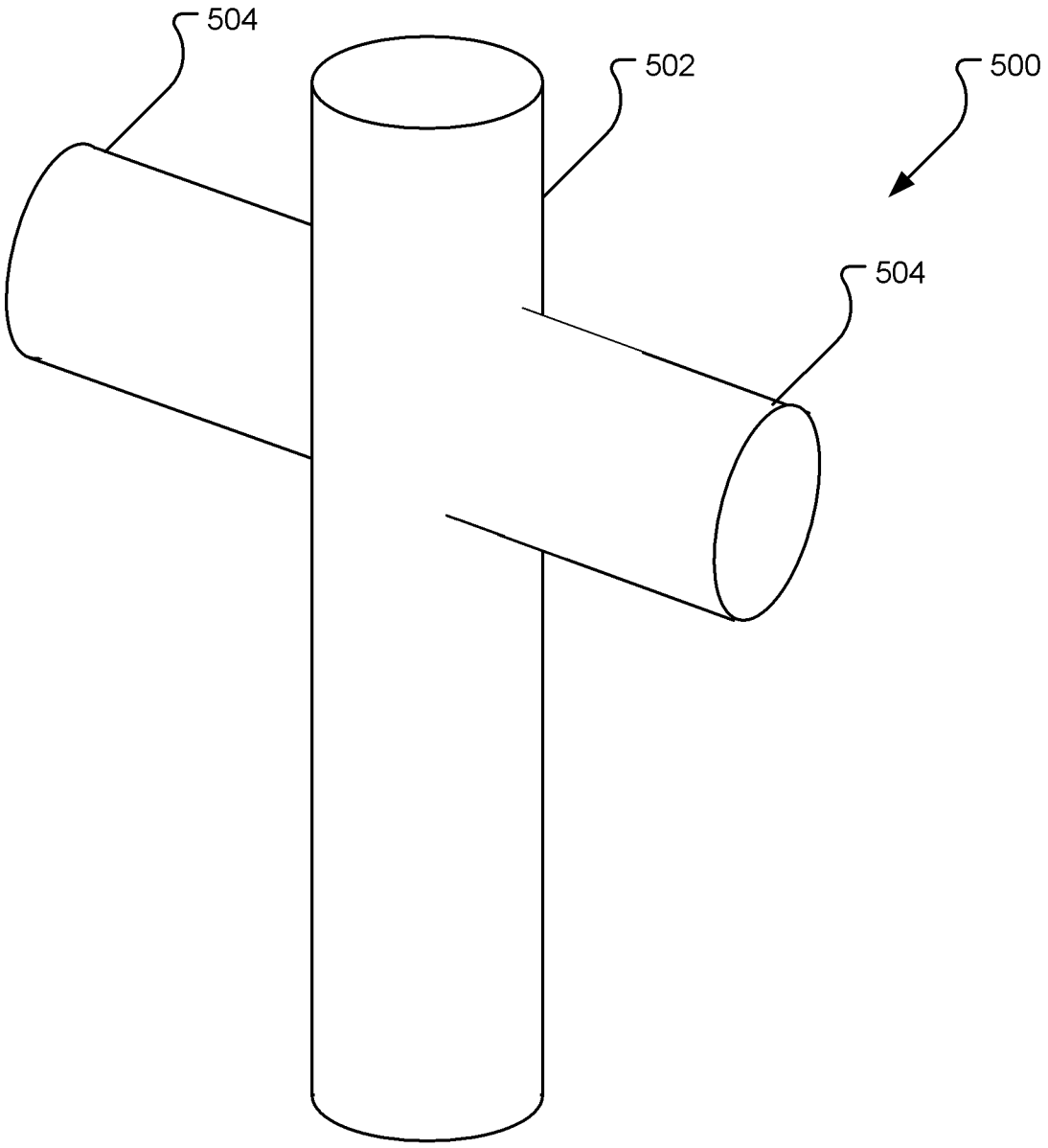
FIG. 5*a* shows an embodiment of a cross shaped target in accordance with the present invention.

Embodiments of the present invention are targets of varying shapes that present different cutting surfaces to the practitioner. FIG. 5*a* shows one example of an embodiment of a cross shaped target 500 having a cylindrical vertical member 502 and a cylindrical horizontal cross member 504. This target shape presents the practitioner with both horizontal 504 and vertical 502 surfaces for cutting. The horizontal member 504 further allows the practitioner to practice vertical downward and upward cuts, such as the kote cut, that are meant to cut completely though a horizontal object. Previously, such cuts were only possible using a dotangiri type stand, and a successful cut would damage the stand. The ability to cut completely through the horizontal member allows the practitioner to practice stopping the weapon appropriately.

Figure 5B:
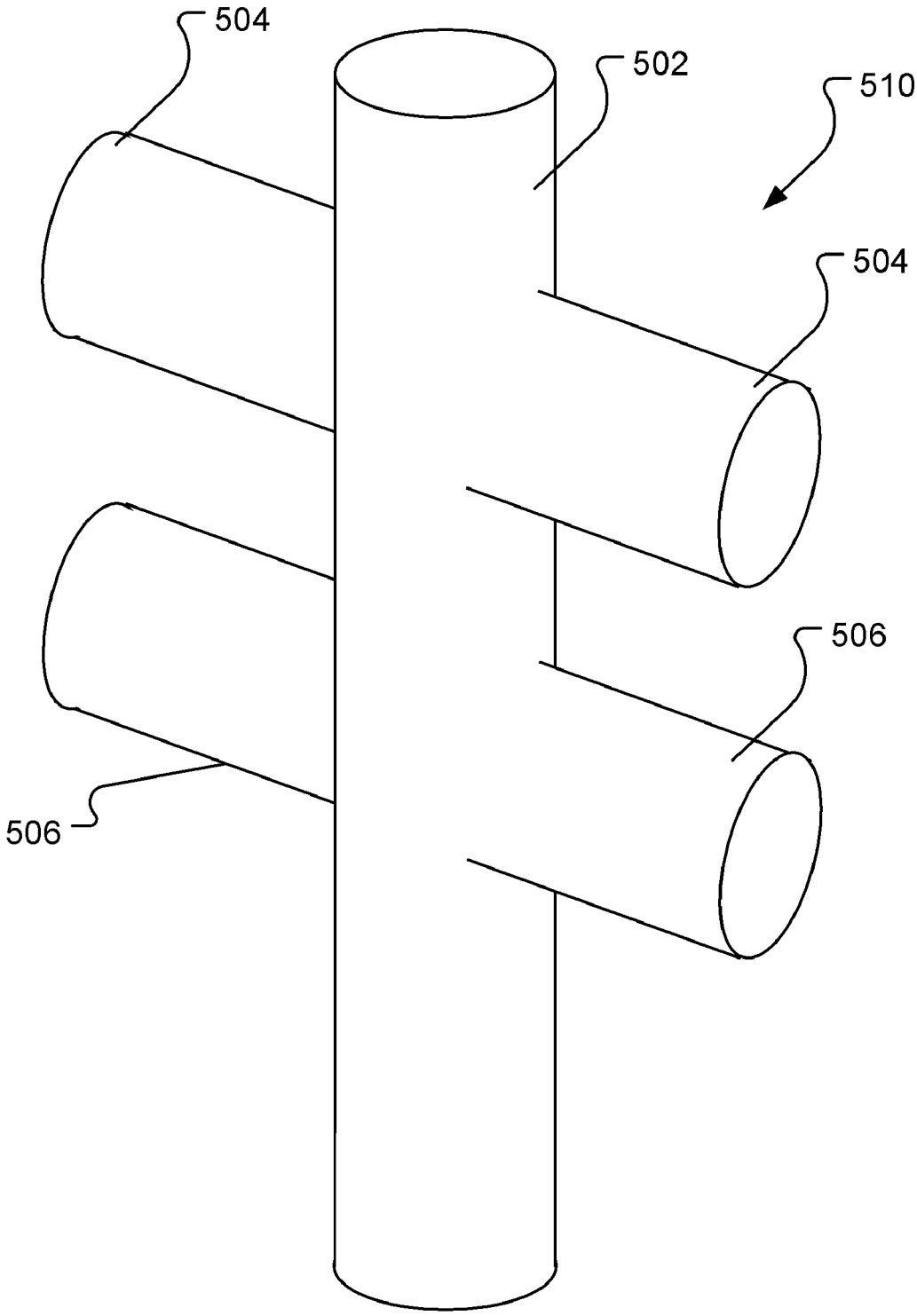
FIG. 5*b* shows another embodiment of a test-cutting target that presents different cutting surfaces to the practitioner.

FIG. 5*b* shows another embodiment of a target 510 that presents different cutting surfaces to the practitioner. As shown, the target includes a cylindrical vertical member 502 and two horizontal cross members 504 and 506.

Figure 5C:
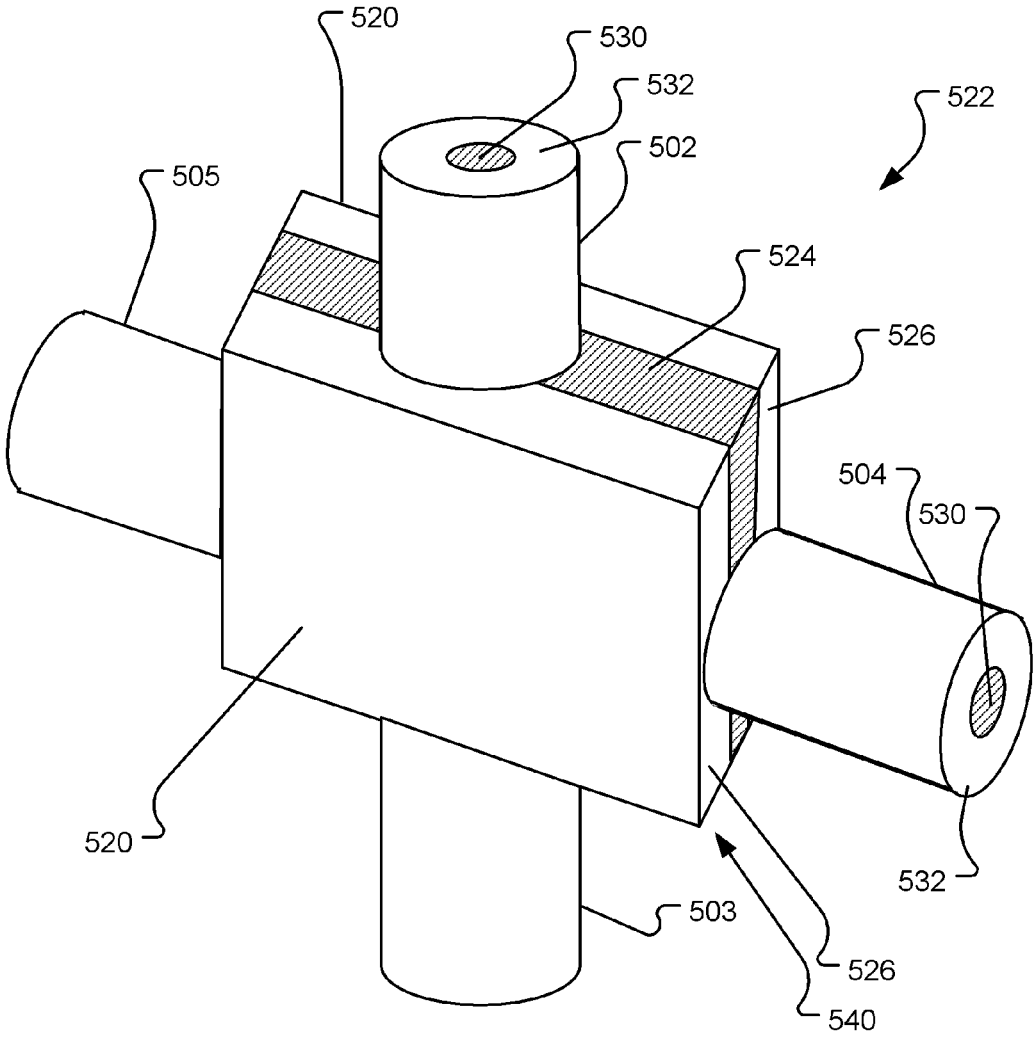
FIG. 5*c* shows yet another embodiment of a test-cutting target presenting horizontal cutting surfaces, vertical cutting surfaces, and two flat surfaces for receiving thrusts.

FIG. 5*c* shows yet another embodiment of a cross shaped target 522 having horizontal members 504, 505 presenting horizontal cutting surfaces, vertical members 502, 503 presenting vertical cutting surfaces and two flat surfaces 520 for receiving thrusts. In the embodiment shown, the horizontal members 504, 505, and vertical members 502, 503 are cylindrical members with different core 530 and sheath 532 materials as described above. In addition, the flat surfaces 520 for receiving thrusts are created by a central block portion 540 made of two outer layers 526 of sheath material sandwiching an inner core layer 524 of material having a different density. In the embodiment shown, the members extend from the central block portion, although other configurations are also possible.

One skilled in the art will recognize that members could be cylindrical, or have rectangular or square cross sections without departing from the scope of the invention.

Targets Shaped for Specific Cutting Sequences

Embodiments of the present invention are test-cutting targets shaped for specific cutting sequences. The targets provide at least two target surfaces that approximate specific anatomical targets on the human body of an imaginary opponent. Such targets include a vertical body member approximating the body of an opponent and at least one arm member approximating an arm of the opponent. The arm member or members may be fixedly attached to the body member at an angle and position to mimic a standard kamae or stance of the opponent. Furthermore, the arm member or members may be rotatably attached to the body member to allow the practitioner to select from multiple kamae. For example, the arm member or members could be rotatable through a low position (gedan no kamae 212) through a middle position (chudan no kamae 204) to an upper position (jodan no kamae 206). Additionally, the target may be provided with a surface for receiving thrusts.

Figure 6A:
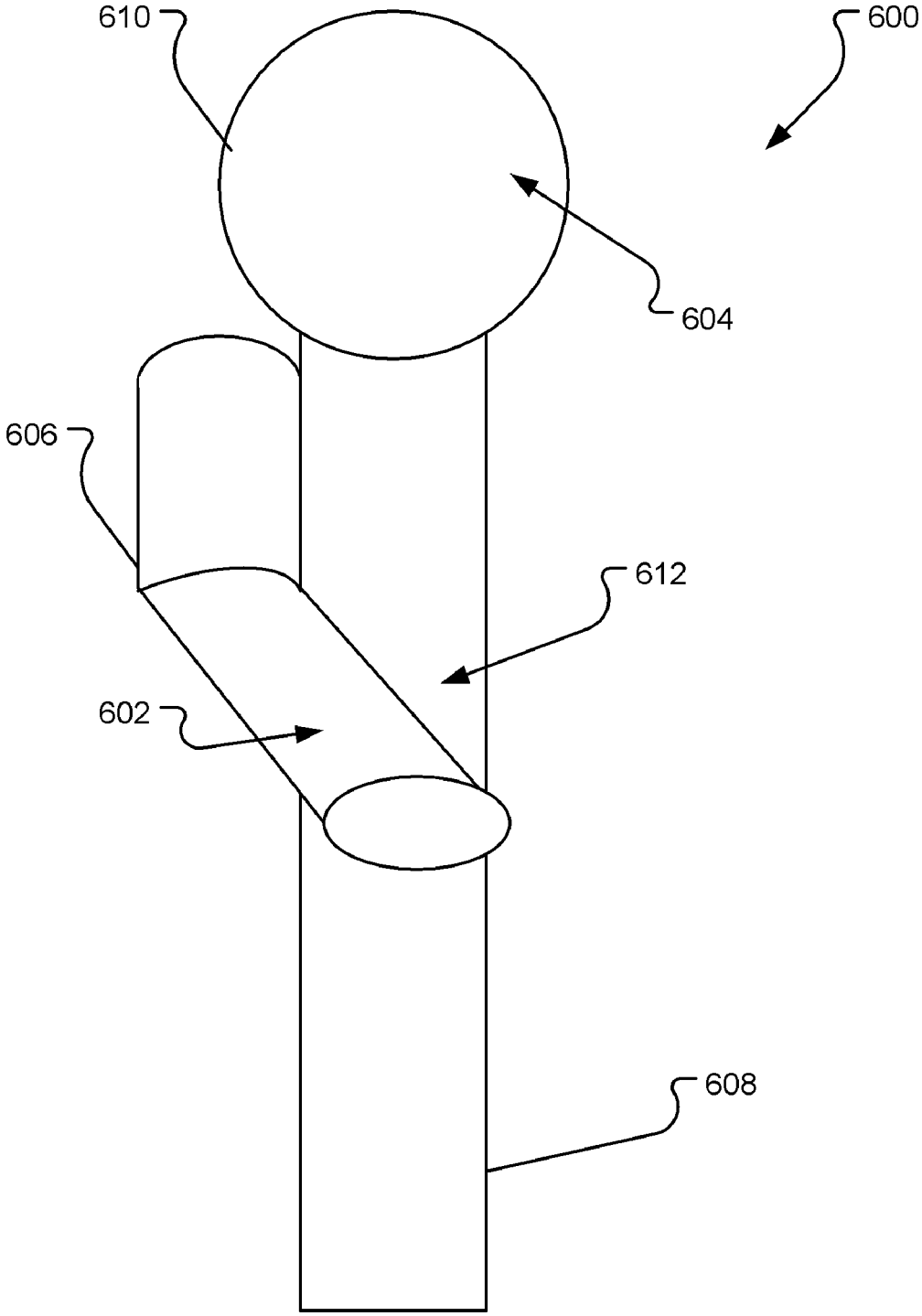
FIG. 6*a* shows a chudan kote-men target in accordance with an embodiment of the present invention.

FIG. 6*a* shows a chudan kote-men target 600 in accordance with an embodiment of the present invention. The target 600 has two distinct target surfaces. A first target surface is a kote surface 602 approximating the location of an imaginary opponent's right wrist when holding a two-handed sword in the chudan position. The target 600 also has a second target surface, a spherical men surface 604, that approximates the location of an imaginary opponent's head when holding a two-handed sword in the chudan position.

In the embodiment shown, the kote surface 602 is created by an arm member 606 attached to a vertical member 608. In the embodiment shown, the arm member 606 is shown as offset from the vertical member 608 and as having a slight bend 610 that more closely approximates the positioning of an opponent's arm relative to the body of the vertical member 608. Alternatively, a straight arm member 606 may be used.

The men surface 604 is created by a roughly spherical portion 610 that presents to a practitioner a roughly perpendicular surface to many different angle cuts to the surface 604. Alternative men surfaces 604 could be provided by eliminating the spherical portion 610 in favor of a traditional cylindrical section or a providing a block section.

The arm member 606 and spherical portion 610 are fixedly attached to the vertical member 608. The attachment may be made with pegs fitting into holes at the appropriate locations. Alternatively the entire target 600 could be made of a single casting of foam or other material, allowing the practitioner to cut any location on the target 600. In yet another embodiment, only the spherical portion 610 and arm member 606 are made of a cuttable material.

The target of FIG. 6*a* allows a practitioner to practice a kote-men sequence of cuts with a real sword, rather than a shinai practice sword. This allows the practitioner to obtain a better feel for the power necessary to perform a kote cut and while still allowing for recovery from the kote cut to perform a men cut.

The target 600 of FIG. 6*a* may be constructed such that the vertical member is part of a stand 100. In this case, at least a portion of the arm member 606 and spherical portion 610 (or whatever portion creates the men surface 604) having the target surfaces 602, 604 would be removable and installable upon the stand for repeated practice. The stand would then have at least two attachment points for attaching two different targets, each having target surfaces oriented differently to present multiple cutting surfaces to the practitioner.

The target in FIG. 6*a* also allows a practitioner to practice a kote-do or kote-men-do cut combination if the vertical member 608 of the target 600 is also made of a cuttable material and thus presenting a vertical do surface 612 for receiving horizontal and diagonal cuts at approximately waist level. In this embodiment wherein the entire target 600 is cuttable, as discussed above, the target 600 may be provided with a hole (not shown) in the base of the target 600 for receiving a retaining pin on a traditional stand 100.

Figure 6B:
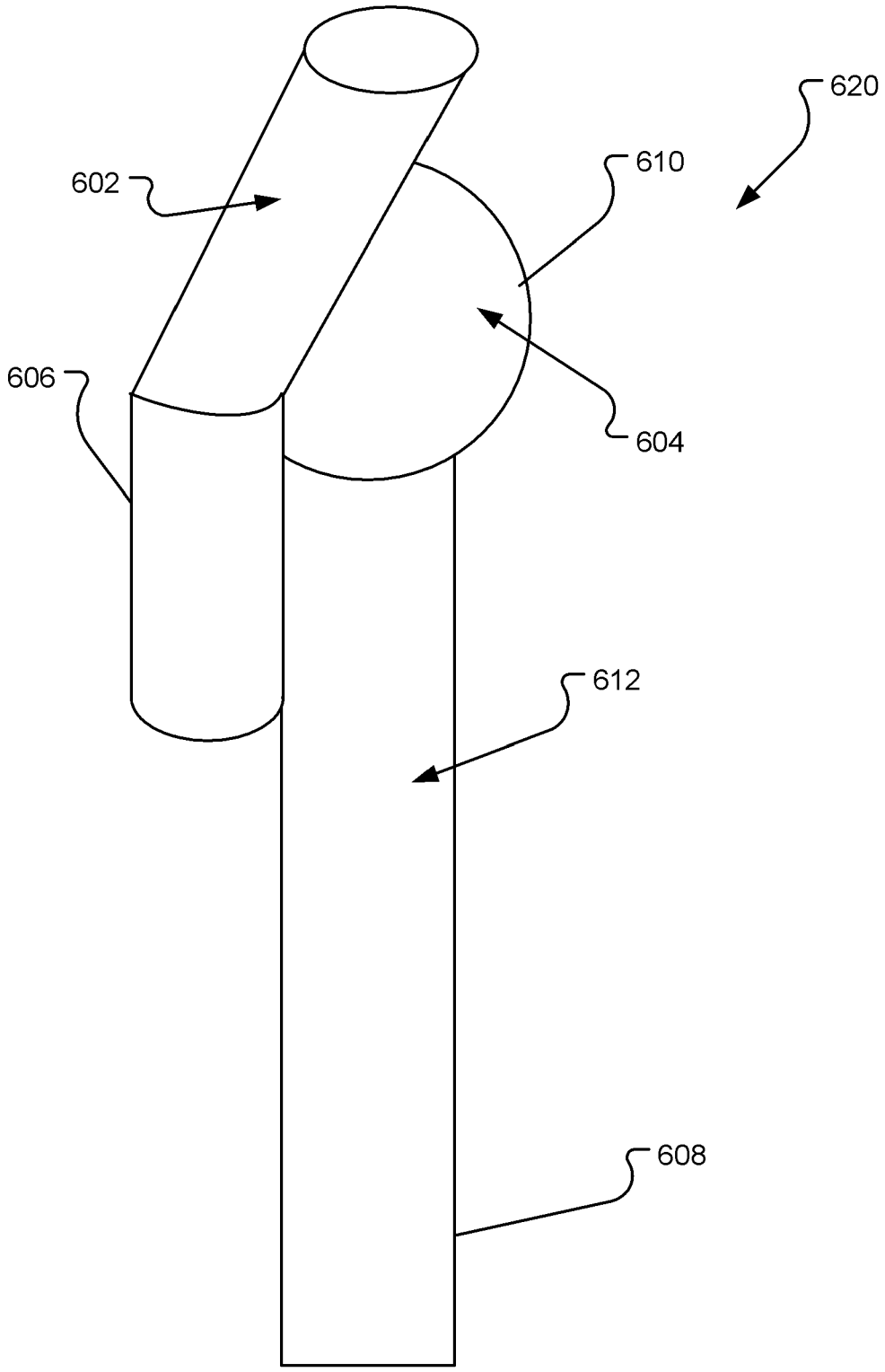
FIG. 6*b* shows a target approximating a jodan no kamae in accordance with an embodiment of the present invention.

FIG. 6*b* shows a target 620 approximating a jodan no kamae in accordance with an embodiment of the present invention. The target 620 shown includes all the same surfaces and members as described in reference to FIG. 6*a*. The primary difference is the location of the arm member 606 relative to the vertical member 608 and spherical surface 610, and thus to the practitioner. This configuration allows a practitioner to practice making a high kote cut and then following up with a men cut, a do cut or a men-do cut combination.

Figure 6C:
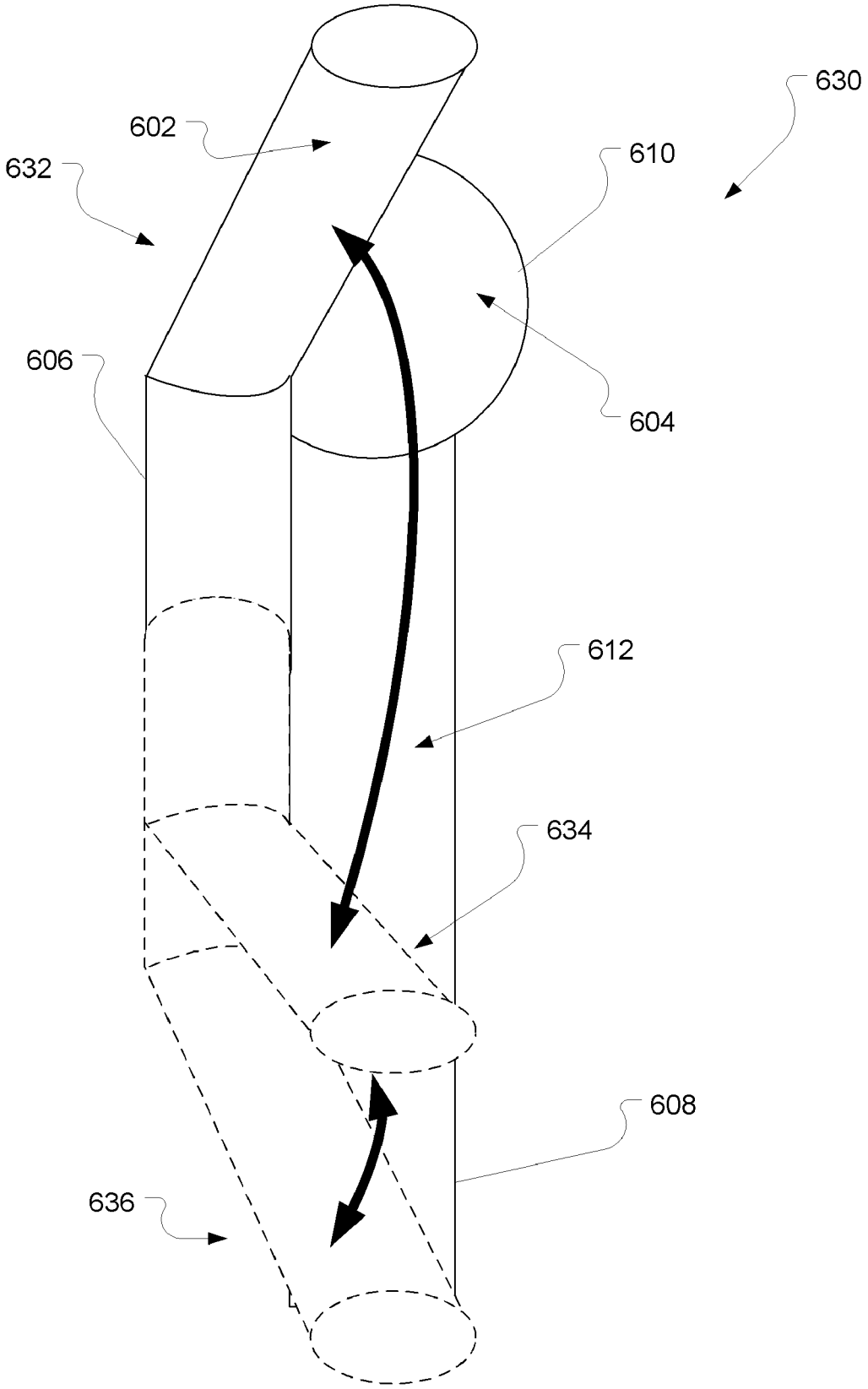
FIG. 6*c* presents yet another embodiment of the present invention is a target having a movable target surface attached to a target body.

FIG. 6*c* presents yet another embodiment of the present invention is a target having a movable target surface attached to a target body. This embodiment allows the movable target surface to be moved to a specific location desired by the practitioner. FIG. 6*c* shows a target body having a men surface 604 and a movable kote surface 602. The movable arm member 606 is shown in jodan position 632 by a solid line. Chudan position 634 and gedan position 636 are also shown, but with the arm member 606 drawn with a dashed line. This embodiment of a test-cutting target allows the practitioner to select whether he wants to simulate an opponent in chudan, jodan, gedan or some other position.

Figure 6D:
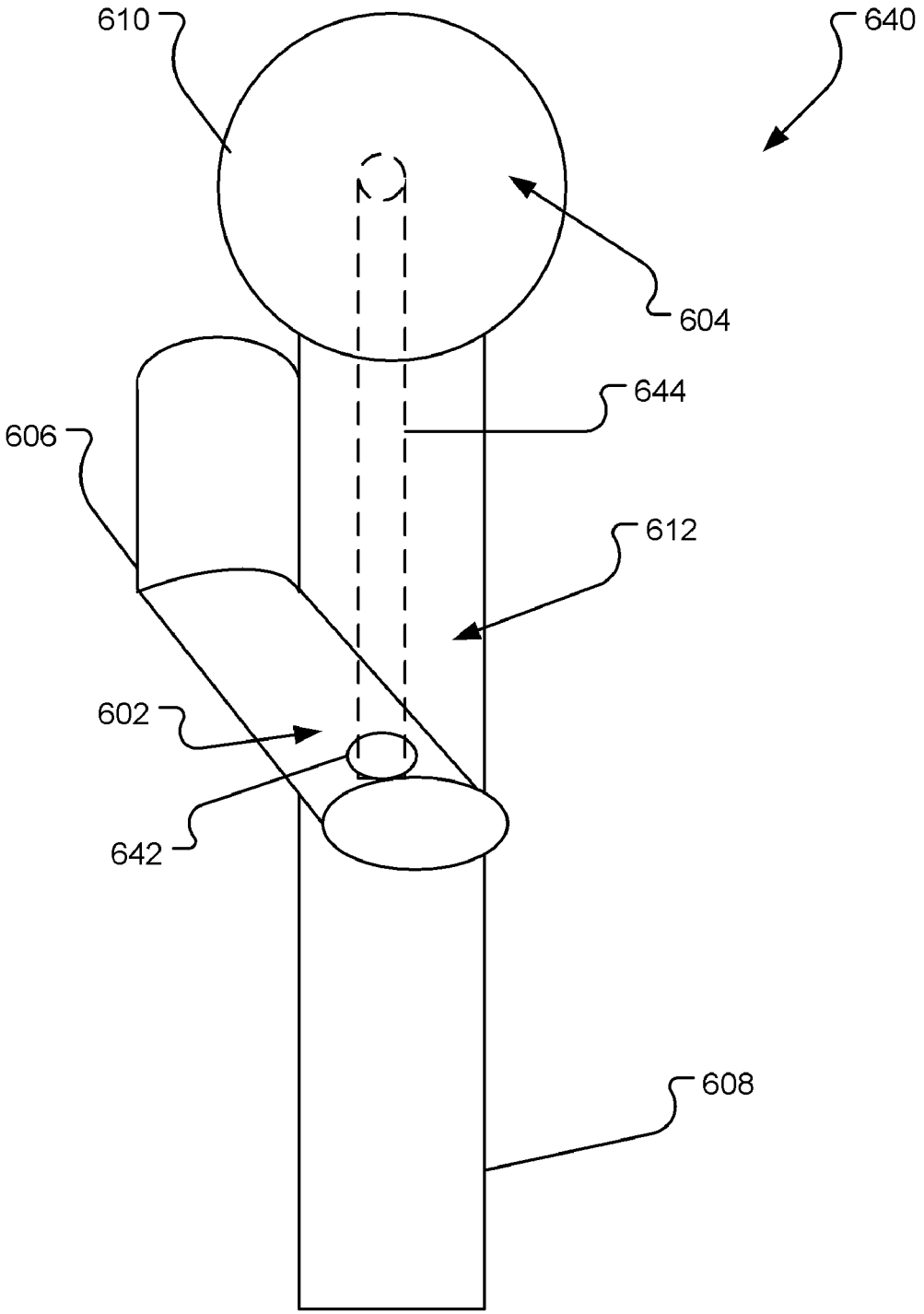
FIG. 6*d* shows yet another embodiment of the present invention wherein the target 640 is provided with a means for attaching a practice sword to the target to further simulate an opponent.

FIG. 6*d* shows yet another embodiment of the present invention wherein the target 640 is provided with a means for attaching a practice sword to the target to further simulate an opponent. As shown in FIG. 6*d* a hole 642 in, and possibly through, the distal end of the arm member 606 near or within the kote surface 602 is provided for receiving the handle of a practice weapon 644 (shown as a dashed line) such as waster, bokken, or shinai. If the arm member 606 is made of a flexible material such as polyethylene foam or moveably attached to the vertical member 608, a practitioner can practice his timing by slapping or knocking the practice sword 644 out of the way before entering and performing his first cut on the kote.

Figure 6E:
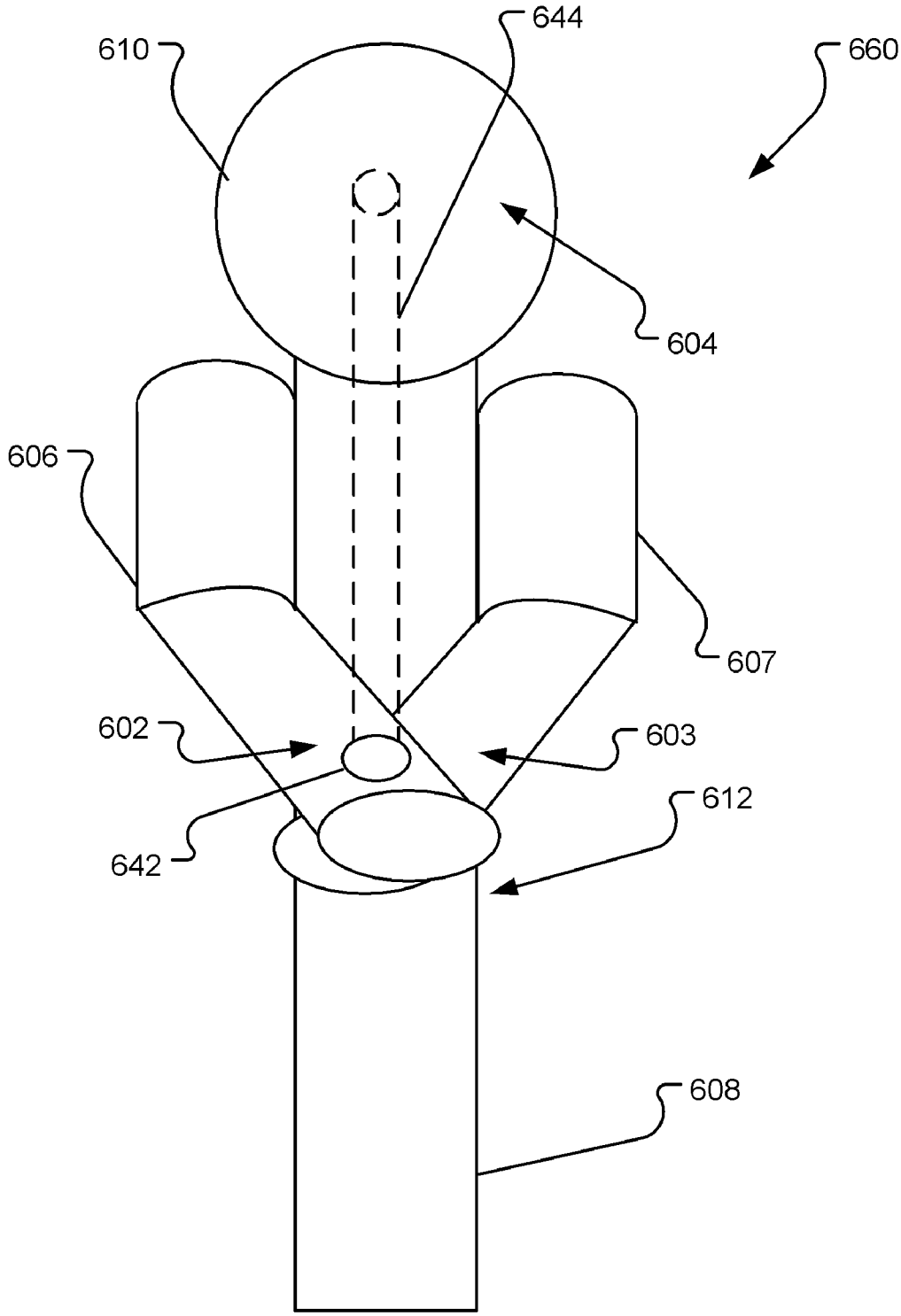
FIG. 6*e* shows yet another embodiment of a test-cutting target having multiple target surfaces.

FIG. 6*e* shows yet another embodiment of a target 660 having multiple target surfaces. The target 650 shown has two opposing arm members 606, 607 attached to a vertical member 608 to approximate the chudan position. Each arm member 606 has a kote surface 602. This target 650, then provides a practitioner with a left kote surface 603, a right kote 602 surface, a men surface 604 and a do surface 612. Furthermore, if the arm members 606, 607 are rotatably mounted to the vertical member 608, The kote surfaces 602 are movably mounted to the target body. The men surface 604 and the do surface 612 are positioned on the "body" formed by the vertical member 608. Again the arm members 606, 607 may be provided with holes 642 for receiving a practice sword 344.

Figure 6F:
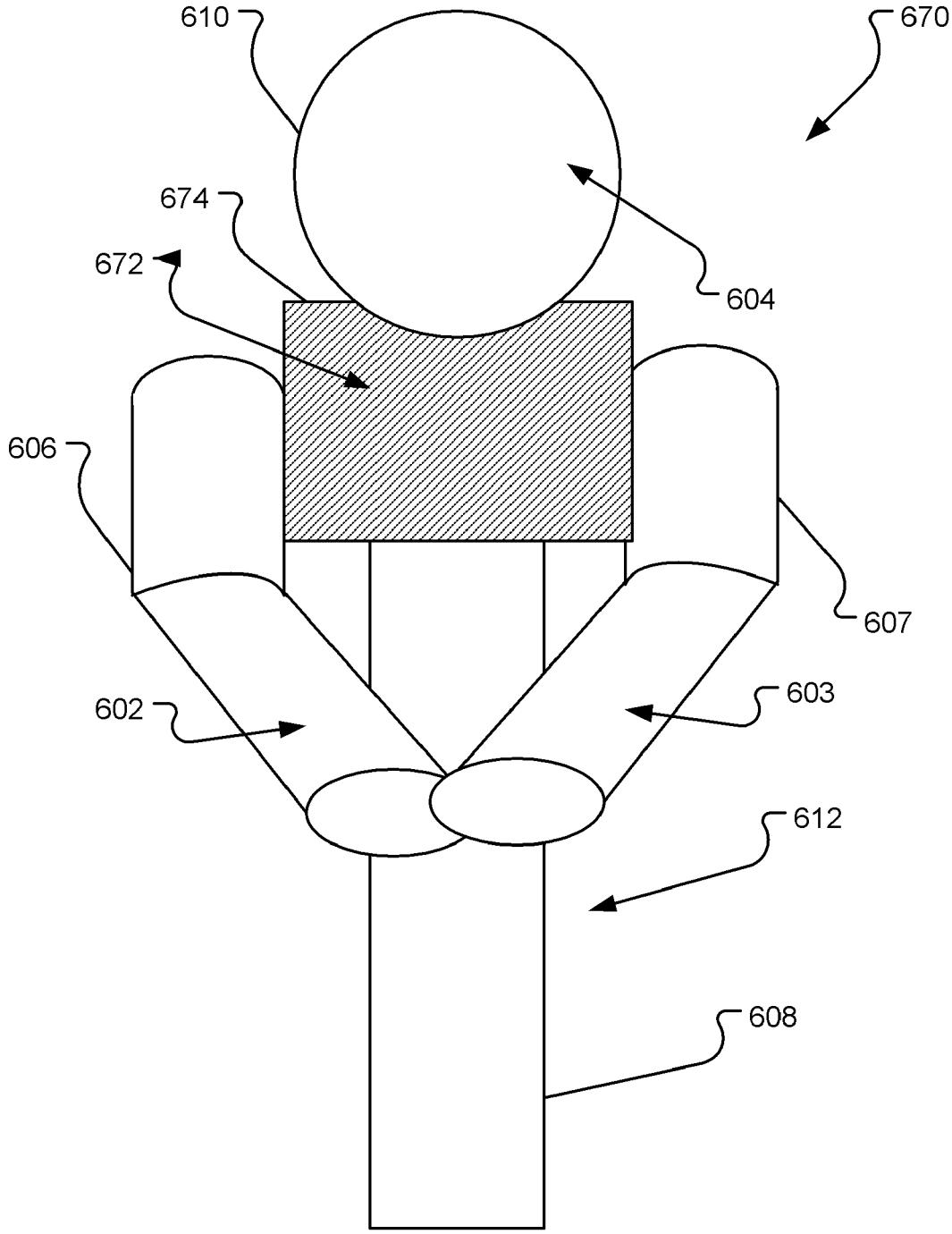
FIG. 6*f* shows yet another test-cutting target having multiple target surfaces including a tsuki surface for receiving thrusts in accordance with another embodiment of the present invention.

FIG. 6*f* shows yet another target 670 having multiple target surfaces 602, 603, 604, 612, 672 including a tsuki surface 672 for receiving a thrust in accordance with another embodiment of the present invention. The tsuki surface 672 (shown filled with diagonal lines) is a substantially flat surface (rather than a curving cylindrical surface presented by a cylindrical member) of the target 670 at about throat height. The tsuki surface 672 may also be wider (as shown) than the vertical member 608 to which it is attached. The tsuki surface 672 may created by adding a block portion 674 to the vertical member 608. The spherical portion 610 may be attached directly to the block portion 674 or a second vertical member 608 may be provided to provide the men surface 604 or support the spherical portion 610. A practitioner can practice thrusting into this surface 672 of the target 670 without worrying that the point will deflect off of a curved surface. Futhermore, in the area behind the tsuki surface 672 the target has a substantially constant thickness. This helps to ensure that each thrust into the tsuki surface 672 will result in a constant and predicable resistance to the thrust as the weapon penetrates the target.

Targets to Replicate Kata of Existing Schools and Styles

Figure 7:
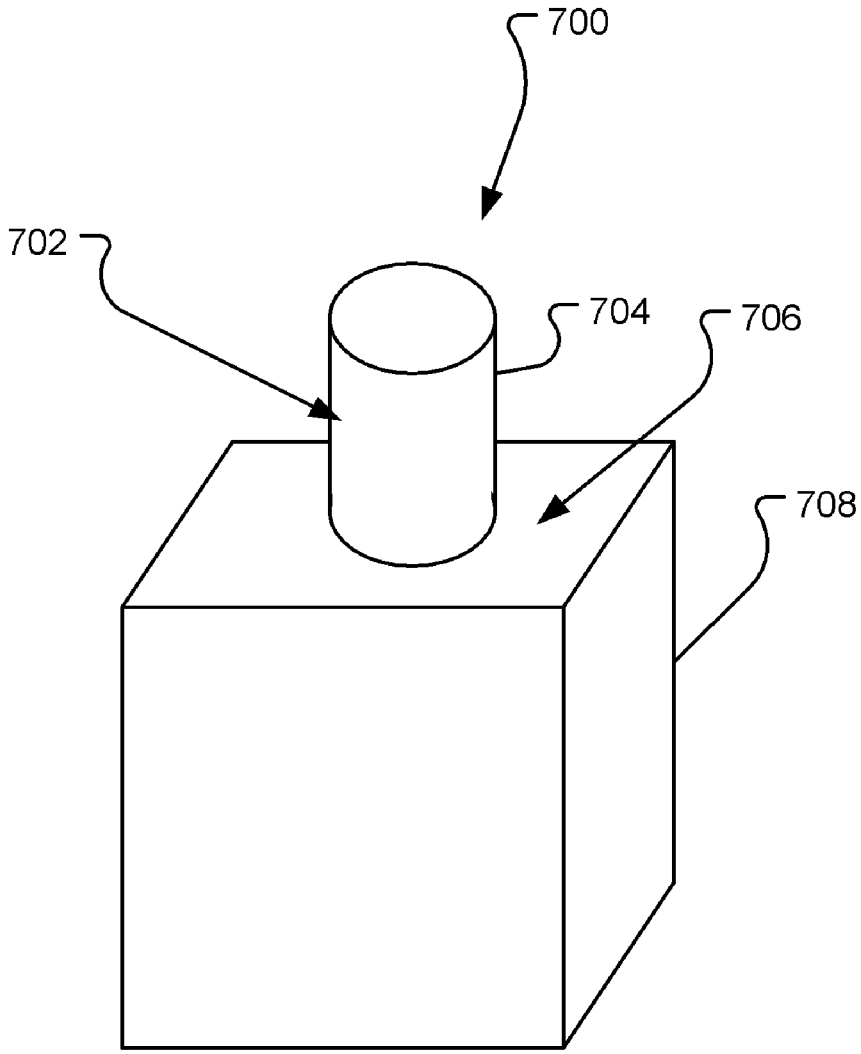
FIG. 7 presents a test-cutting target for practicing the horizontal and vertical cuts of the first kata of the All Japan Iaido Federation in accordance with the present invention.

Embodiments of the present invention can be combined to create a set of targets having specific surfaces on each target. For example, in Iaido, the traditional kata include serveral kata requiring a horizontal cut at the head level, from a seated position, followed by a vertical downward cut into a lower level. (Such kata could be practiced by providing a target 700 having a vertical surface 702 provided by a vertical member 704 above a horizontal surface 706, as could be created by a vertical member 704 extending from a block member 708 as shown in FIG. 7. If the target 700 is made of a material having uniform cutting properties, then these two perpendicular cuts could be safely performed.) Another kata has only a downward vertical cut. Another kata has only a diagonal cut.

An embodiment of present invention is a kit of targets, each target providing the appropriate multiple surfaces to perform a specific one of a set of predefined kata. The kit would could include the complete set of targets to practice a predetermined set of predefined kata requiring cuts to multiple different surfaces using one stand.

Embodiments of the present invention also include a method of creating test-cutting targets for cutting by an edged weapon. The method includes identifying a sequence of cuts, such as the cuts in a predefined kata, to be practiced that require a plurality of differing cutting surfaces. Then identifying each of the differing cutting surfaces necessary to practice those cuts and a relative position of each of the surfaces necessary to perform the sequence. Then forming a test-cutting target of one or more uniform cutting materials having each of the plurality of differing cutting surfaces. The target must be formed so that each of the plurality of differing cutting surfaces are located at the relative position necessary to perform the sequence. The sequence of cuts may also include thrusts and therefore the target may also require one or more tsuki surfaces for receiving thrusts.

It will be clear that the present invention is well adapted to attain the ends and advantages mentioned as well as those inherent therein. While a presently preferred embodiment has been described for purposes of this disclosure, various changes and modifications may be made which are well within the scope of the present invention. Numerous other changes may be made which will readily suggest themselves to those skilled in the art and which are encompassed in the spirit of the invention disclosed and as defined in the appended claims.

I claim:

1. A test-cutting target for cutting with edged weapons comprising:

an outer tube portion made of a first material defining a cylindrical space therein and having a smooth exterior cutting surface;

an inner cylindrical portion within the outer tube portion, the cylindrical portion substantially filling the cylindrical space defined by the outer tube portion and made of a second material denser than the first material;

wherein the test-cutting target includes an indicator indicative of the test-cutting target's density relative to other test-cutting targets; and wherein the indicator is part of the cutting surface of the outer tube portion.

2. The test-cutting target of claim 1, wherein the outer tube portion is made of a polyethylene foam and the inner cylindrical portion is made of a denser polyethylene foam.

3. The test-cutting target of claim 1, wherein the inner cylindrical portion is made of hardened foam.

4. The test-cutting target of claim 3, wherein the hardened foam has a specific gravity between 0.08 to 1.5.

5. The test-cutting target of claim 1, wherein at one end of the inner cylindrical portion is a bole having a depth for receiving a peg from a test cutting stand.

6. The test-cutting target of claim 5, wherein the exterior cutting surface of the outer tube portion has one or more marks indicating safe locations to cut based on the depth of the hole.

7. The test-cutting target of claim 1, wherein the outer tube portion and inner cylindrical portion are irremovably attached.

8. The test-Cutting target of claim 1, wherein the outer tube portion is seamless.

9. A kit comprising:

a plurality of test-cutting targets, each test-cutting target including an outer tube portion made of a first material defining a cylindrical space therein and having a smooth exterior cutting surface;

an inner cylindrical portion within the outer tube portion, the cylindrical portion substantially filling the cylindrical space defined by the outer tube portion and made of a second material denser than the first material;

wherein the test-cutting target includes an indicator indicative of the test-cutting target's density relative to other test-cutting targets; wherein at one end of the inner cylindrical portion is a hole having a depth for receiving a peg from a test cutting stand; and wherein the exterior cutting surface of the outer tube portion has one or more marks indicating safe locations to cut based on the depth of the hole; and at least one peg having a first end for insertion into the hole of the test-cutting target and a second end for attachment to a test cutting stand.

10. The test-cutting target of claim 9, wherein at least one of the outer tube portion and the and the inner cylindrical portion comprises a polyethylene foam.

11. The test-cutting target of claim 10, wherein the outer tube portion is made of a polyethylene foam and the inner cylindrical portion is made of a denser polyethylene foam.

* * * * *